United States Patent [19]

Counterman

[11] Patent Number: 4,559,998

[45] Date of Patent: Dec. 24, 1985

[54] RECUPERATIVE HEAT EXCHANGER HAVING RADIATION ABSORBING TURBULATOR

[75] Inventor: Wayne S. Counterman, Wellsville, N.Y.

[73] Assignee: The Air Preheater Company, Inc., Wellsville, N.Y.

[21] Appl. No.: 619,746

[22] Filed: Jun. 11, 1984

[51] Int. Cl.[4] ..... F28F 13/12; F28F 13/18

[52] U.S. Cl. ..... 165/109.1; 122/44 A; 122/DIG. 13; 126/901; 138/38; 165/133; 165/904

[58] Field of Search ..... 165/133, DIG. 6, 109 R, 165/109 T; 126/901, 417; 138/38; 122/44 A, 155 A, DIG. 13

[56] References Cited

U.S. PATENT DOCUMENTS

| | | | |
|---|---|---|---|
| 1,770,208 | 7/1930 | Kemral | 165/95 |
| 3,886,976 | 6/1975 | Kardas et al. | 165/DIG. 6 X |
| 3,987,780 | 10/1976 | Nozik et al. | 126/901 X |
| 4,055,707 | 10/1977 | McDonald | 126/901 X |
| 4,122,831 | 10/1978 | Mahdjuri | 126/901 X |
| 4,174,750 | 11/1979 | Nichols | 138/38 X |
| 4,334,523 | 6/1982 | Spanoudis | 126/901 X |
| 4,351,392 | 9/1982 | Stockman | 165/DIG. 6 X |
| 4,356,815 | 11/1982 | Spanoudis | 126/449 X |
| 4,361,630 | 11/1982 | Johnson, Sr. | 126/901 X |
| 4,479,534 | 10/1984 | Rhodes | 165/DIG. 6 X |

FOREIGN PATENT DOCUMENTS

| | | | |
|---|---|---|---|
| 2912011 | 10/1980 | Fed. Rep. of Germany | 122/44 A |
| 0112694 | 7/1982 | Japan | 165/109 T |
| 86913 | 10/1920 | Switzerland | 165/DIG. 6 |

*Primary Examiner*—Sheldon J. Richter
*Assistant Examiner*—Randolph A. Smith
*Attorney, Agent, or Firm*—William W. Habelt

[57] ABSTRACT

A tubular recuperative heat exchanger (10) is adapted for transferring heat from a hot gas stream having a temperature of 1200 F. flowing over the outside surface of the heat exchange tubes (12) to a cold gas stream flowing therethrough. A turbulator (22) is disposed within each heat exchange tube (12) to improve convective heat exchange. The turbulator (22) is coated with a material having a higher absorptivity than that of the underlying surface of the turbulator. Further, the inside surface (24) of the heat exchange tubes (12) may be coated with a material having a higher emissivity than that of the underlying inside surface of the heat exchange tubes.

6 Claims, 3 Drawing Figures

RECUPERATIVE HEAT EXCHANGER HAVING RADIATION ABSORBING TURBULATOR

BACKGROUND OF THE INVENTION

The present invention relates to tubular type heat exchangers wherein heat is transferred from a hot fluid flowing over the tubes to a cooler fluid to be heated flowing through the tubes and, more particularly, to such a tubular heat exchanger wherein a turbulator is disposed within the tube to increase convective heat transfer to the fluid flowing through the tube by creating turbulence which reduces the formation of boundary layers along the inside tube wall.

Recuperative heat exhangers of the tubular type are well known in the art. Such recuperative heat exchangers typically comprising a housing defining a flow conduit through which the hot fluid, typically flue gas from a boiler, passes. A plurality of heat exchange tubes are disposed to extend through the housing tranversely to the flow of the hot fluid therethrough. The cooler fluid, typically combustion air, to be heated is passed through the interior of the tubes in indirect heat exchange relationship with the hot fluid flowing over the outside of the heat exchange tubes. As the hot fluid flows over the outside of the heat exchange tubes, the hot fluid is cooled by transferring some of its heat to the tube by convection. The heat absorbed by the tube walls is in turn transferred by convection to the cooler fluid flowing through the interior of the tubes thereby heating the cooler fluid.

It is known in the prior art to provide turbulator means within the interior of the heat exchange tubes to create a turbulent flow through the interior of the heat exchange tubes thereby breaking down the formation of boundary layers along the inside tube wall which would hinder convective heat transfer. A typical type of turbulator, as shown in U.S. Pat. No. 1,770,280, comprises a relatively thin, elongated, twisted ribbon of material having a width slightly less than the inside diameter of the heat exchange tube. As the cooler fluid to be heated passes through the heat exchange tube, it must follow a spiral path about this twisted ribbon of material. Because of this, turbulent flow is established within the heat exchange tube and boundary layer formation along the inside wall is greatly reduced.

Turbulent heat exchangers with turbulators are typically employed to transfer heat from a flue gas having a temperature in the range of 500 F. to 1500 F. to a stream of ambient air to be heated for combustion. In this range of temperatures, convection heat transfer is responsible for most of the heat exchange. However, radiative heat exchange is significant with the hot fluid in the temperature range of about 1800 F. or higher, and is present to a lesser extent at temperatures as low as 1200 F. Typical prior art tubular recuperators of the type described above are not satisfactorily equipped to take advantage of radiative heat transfer from these hot fluids.

Accordingly, it is therefore an object of the present invention to enhance the performance of such tubular heat exchangers for use in transferring heat from a hot fluid to a cooler fluid by enhancing radiative heat transfer from the hot fluid to the cooler fluid.

A further object of the present invention is to enhance radiative heat transfer from the hot fluid to the cooler fluid by augmenting radiative heat transfer from the heat exchange tube to the turbulator disposed therein whereby the turbulator receives a portion of the heat transferred to the heat exchange tubes from the hot fluid and in turn transfers this heat by convection to the cooler fluid flowing through the interior of the heat exchange tubes and over the turbulator disposed therein.

SUMMARY OF THE INVENTION

In accordance with the present invention, a tubular recuperative heat exchanger is provided for transferring heat from a hot gas stream having a temperature of about 1800 F. and higher flowing over the outside surface of the heat exchange tubes to a cold stream flowing through the heat exchange tubes wherein turbulator means disposed within the heat exchange tubes for preventing laminar flow in the cold gas stream passing through the heat exchange tubes are coated with a radiation absorbing material having a higher absorptivity than the underlying surface of the turbulator means whereby the turbulator means is made a better radiation receiver. Preferably, the radiation absorbing material used to coat the turbulator means has an absorptivity of at least about 0.90.

Further in accordance with the present invention, a coating of radiation emitting material is deposited on the inside surface of the heat exchange tubes through which the cold gas is flowing whereby the heat exchange tubes are made better transmitters of radiation to the turbulator means. The radiation emitting material must have a higher emissivity than the underlying inside surface of the heat exchange tubes. Preferably, the material used to coat the inside surface of the heat exchange tubes has an emissivity of at least about 0.90.

Preferably, both the turbulator means and the inside surface of the heat exchange tubes are coated with a single material, the material having both a high emissivity and a high absorptivity, such as carbon black and black chrome oxide.

BRIEF DESCRIPTION OF THE DRAWING

A better understanding of the invention and its objects may be had with reference to the following detailed description of the preferred embodiment shown in the accompanying drawings, wherein.

DESCRIPTION OF THE PREFERRED EMBODIMENT

Figure 1:
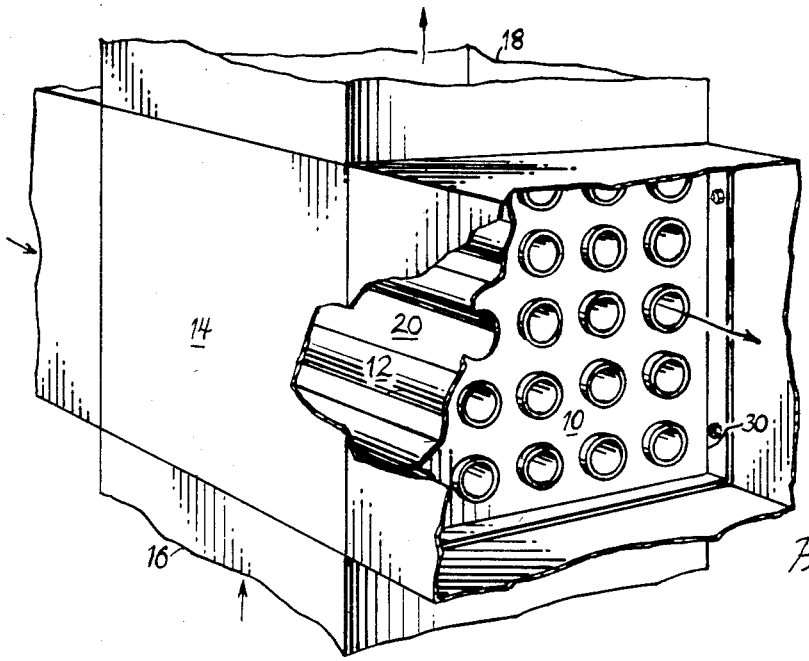
Fig. 1 Prior Art
FIG. 1 is a perspective view of a typical turbulent heat exchanger partially in section to show a turbulator disposed within a heat exchange tube.
Figure 3:
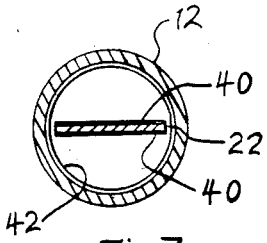
FIG. 3 is an enlarged cross-sectional end view taken along line 3—3 of FIG. 1.
Figure 2:
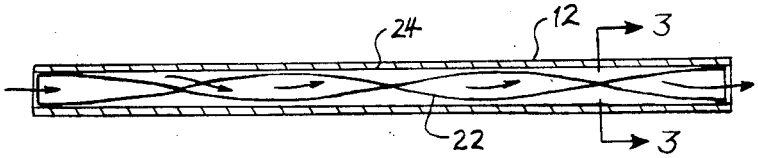
FIG. 2 is an enlarged cross-sectional view of a single tube of the heat exchanger of FIG. 1 showing the disposition of a turbulator within the tube.

Referring now to the drawing, there is depicted therein a tubular recuperative heat exchanger 10 adapted for transferring heat from a hot gas flowing externally over the tubes 12 of the tubular heat exchanger 10 to a cold gas to be heated flowing through the tubes 12. The tubular heat exchanger 10 comprises a housing 14 having an inlet 16 and an outlet 18 for directing the flow of the hot gas stream through a flow conduit 20 defined within the housing 12 between the gas inlet 16 and gas outlet 18 thereto. A plurality of heat exchange tubes 12 are disposed within the housing 14 so as to extend across the gas flow conduit 20 therethrough transversely to the flow of hot gas through the gas flow conduit 20. The heat exchange tubes 12 are supported at both of their ends by apertured tube sheets 30 mounted to the housing 14. The ends of each of the tubes 12 penetrate the apertured tube sheets 30 through openings in the tube sheets 30 adapted to receive the heat exchange tubes 12.

In operation, hot gas flows through the housing 14 from the gas inlet 16 to the gas outlet 18 thereof over the external surface of each of the heat exchange tubes 12. As the hot gas passes over the heat exchange tubes 12, the hot gas transfers heat by convection and, at high temperatures, by radiation to the tubes 12. At the same time, cold gas flows through the interior of each of the tubes 12 in indirect heat exchange relationship with the hot gas stream flowing over the external surface of each of the heat exchange tubes 12. As the cold gas flows through the heat exchange tubes 12, it is heated by heat transferred from the inside surface of the heat exchanger tubes 12 by convection to the cold gas flowing thereto.

In order to enhance the convection heat transfer from the inside surface of the heat exchange tubes 12 to the cold gas flowing therethrough, it has become common to dispose a turbulator means within the heat exchange tubes for preventing laminar flow in the cold gas stream passing therethrough. It is well known in the art that maintaining a turbulent flow in the cold gas stream passing through the heat exchange tubes will increase the convection heat transfer coefficient between the inside walls of the tubes 12 and the cold gas flowing therethrough.

Although the turbulator means may be comprised of a number of designs well known in the art, the turbulator 22 most commonly comprises a thin twisted metallic strip having a width slightly less than the inside diameter of the heat exchange tube 12. This thin twisted metallic strip 22 is disposed within the heat exchange tubes 12 coaxially along the longitudinal axis of the heat exchange tubes 12. Typically, the turbulator means 22 extends along the full length of the heat exchange tube 12. In prior art heat exchangers, this turbulator means typically does not participate directly in the transfer of heat to the cold gas but rather merely causes the gas flow passing through the heat exchange tubes 12 to follow a convoluted path through the interior of the heat exchange tube 12 thereby preventing the formation of a laminar flow within the heat exchange tube 12 and the consequent boundary layer build-up along the inside wall of the heat exchange tube 12 which would act as a barrier to convective heat transfer.

In accordance with the present invention, the turbulator means is made to participate actively in the heat exchange process by receiving heat by radiative heat transfer directly from the inside surface of the heat exchange tubes 12 and transferring that heat by convective transfer directly to the cold gas flowing over the turbulator means 22 as it passes through the heat exchange tubes 12. Accordingly, the turbulator mean 22 is coated with a radiation absorbing material 40 having a absorptivity greater than the absorptivity of the underlying surface of the turbulator means. Thus, the turbulator means is made a better radiation receiver. Therefore, by enhancing the radiation absorbing ability of the turbulator means, the turbulator means will absorb heat radiation being emitted from the inside surface 24 of the hot exchange tubes 12 as they become heated by the hot gas flowing over the outside of the heat exchange tubes 12.

To further enhance radiative heat transfer between the inside surface of the heat exchange tubes 12 and the turbulator means 22, it is contemplated that the inside surface 24 of the heat exchange tubes 12 be coated with a radiation emitting material 42 having a higher emmisivity than the underlying inside surface 24 of the heat exchange tubes 12. In this manner, the heat exchange tubes 12 are made better radiation transmitters and will consequently transfer more heat at a given temperature to the turbulator means due to the higher emissivity of the surface coating. By transferring heat from the inside surface 24 of the heat exchange tubes 12 directly to the turbulator means 22, it is believed that the overall transmission of heat to the cold gas flowing through the heat exchange tubes 12 will be increased. This is because the turbulator means 22 is now linked to the inside surface 24 by radiation, thus making it effectively a fin or secondary surface extension of the inside surface 24 of the tubes 12. Therefore, by transferring heat from the heat exchange tubes 12 to the turbulator means 22 and then subsequently by convection from the tubulator means 22 to the cold gas flowing through the tube 12, it is expected that the overall heat transfer process will be made more efficient. As a consequence of increasing the efficiency of the process, the overall length of the heat enchange tubes 12 and turbulator means 22 necessary to transfer a given amount of heat from the hot gas to the cold gas will be decreased thereby resulting in a savings in material and cost.

A number of materials well known in the art would be suitable coatings for increasing either the radiation absorption by the turbulator means 22 or the radiation emission by the inside surface 24 of the heat exchange tubes 12. In fact, certain materials are known which not only have a high absorptivity and will therefore increase the absorption of radiation but also have a high emissivity and will therefore also increase radiation emission. It is most desirable that such a material having both a high absorptivity and a high emissivity be used to coat both the turbulator means 22 and the inside surface 24 of the heat exchange tubes 12. Preferably, the turbulator means and the inside surface of the heat exchange tubes are coated with a coating of material selected from the group consisting of carbon black and black chrome oxide.

Further, it is preferred that the radiation absorption material used to coat the turbulator means have an absorptivity of at least about 0.90 and that the radiation emitting material used to coat the inside surface of the heat exchange tubes have an emissivity of at least 0.90. Typically, the heat exhange tubes 12 are made of carbon steel or stainless steel and, therefore, the inside surface 24 of an uncoated heat exchange tube 12 would typically have an emissivity in the range of 0.60 to 0.65 at the typically encountered tube temperatures. Further, typical turbulator means are comprised of a thin strip of a metal such as aluminum or even a high temperature synthetic plastic and, therefore, an uncoated turbulator would have a very low absorptivity, typically less than 0.20. Thus, it is evident that by increasing the surface absorptivity of the turbulator means 22 to a value of at least about 0.90 and also increasing the surface emissivity of the inside surface 24 of the heat exchange tube 12 to a value of at least about 0.90 will greater enhance the transfer of heat radiation from the heat exchange tubes 12 to the turbulator means 22 as is the object of the present invention.

Accordingly, there has been provided in accordance with the present invention an improved recuperative heat exchanger for use in transferring heat from a hot radiating gas stream having a temperature of about 1200° F. and higher to a cold gas stream. It is to be understood that the specific embodiment of the recuperative heat exchanger shown in the drawing is merely illustrative of the preferred embodiment and presently contemplated by the applicant for carrying our the invention and is by no means meant as a limitation to the many varied forms of tubular heat exchangers to which the invention may be applicable. Accordingly, it is intended that any modification which is apparent to those skilled in the art in light of the foregoing description and which falls within the spirit and scope of the appended claims be included in the invention as recited therein.

What is claimed is:

1. A recuperative heat exchanger for use in transferring heat from a hot gas stream having a temperature of about 1200° F. and higher to a cold stream, comprising:

a. a housing defining a flow conduit therethrough, said housing having an inlet and an outlet for directing the hot gas stream through said flow conduit;

b. a plurality of heat exchange tubes extending through said housing transversely to the flow of hot gas through said flow conduit for directing the cold gas stream therethrough in indirect heat exchange relationship with the hot gas stream flowing over said heat exchange tubes, and c. turbulator means disposed within said heat exchange tubes for preventing laminar flow in the cold gas stream passing through said heat exchange tubes, said turbulator means being coated with a radiation absorbing material having an absorptivity greater than the absorptivity of the underlying surface of said turbulator means whereby said turbulator means is made a better radiation receiver.

2. A recuperative heat exchanger as recited in claim 1 wherein said turbulator means is coated with a coating of radiation absorbing material having a absorptivity of at least about 0.90.

3. A recuperative heat exchanger as recited in claim 1 wherein said turbulator means is coated with a coating of material selected from the group consisting of carbon black and black chrome oxide.

4. A recuperative heat exchanger as recited in claim 1 further comprising a coating of radiation emitting material on the inside surface of said heat exchange tubes, said radiation emitting material having a higher emissivity than the underlying inside surface of said heat exchange tubes whereby the heat exchange tubes are made better radiation transmitters to said turbulator means.

5. A recuperative heat exchanger as recited in claim 4 wherein the coating on said turbulator means and on the inside surface of said heat exchange tubes comprises a coating of radiation emitting material having an emissivity of at least about 0.90.

6. A recuperative heat exchanger as recited in claim 4 wherein said turbulator means and the inside surface of said heat exchange tubes are coated with a coating of material selected from the group consisting of carbon black and black chrome oxide.

* * * * *